US005819572A

United States Patent [19]

Krajewski

[11] Patent Number: 5,819,572

[45] Date of Patent: Oct. 13, 1998

[54] LUBRICATION SYSTEM FOR HOT FORMING

[75] Inventor: Paul Edward Krajewski, Sterling Heights, Mich.

[73] Assignee: General Motors Corporation, Detroit, Mich.

[21] Appl. No.: 898,634

[22] Filed: Jul. 22, 1997

[51] Int. Cl.[6] ..... B21B 45/02

[52] U.S. Cl. ..... 72/42; 508/155

[58] Field of Search ..... 72/41, 42, 43, 72/54, 56, 60, 63, 62; 508/154, 155

[56] References Cited

U.S. PATENT DOCUMENTS

| | | | |
|---|---|---|---|
| 2,594,822 | 4/1952 | Beerbover et al. | 508/154 |
| 2,614,986 | 10/1952 | Beerbower et al. | 508/154 |
| 4,269,053 | 5/1981 | Agrawal et al. | 72/42 |
| 4,358,544 | 11/1982 | Skedgell | 501/77 |
| 4,469,757 | 9/1984 | Ghosh et al. | 428/614 |
| 4,706,361 | 11/1987 | Meyer et al. | 29/423 |
| 4,934,580 | 6/1990 | Sutton | 228/157 |
| 4,984,348 | 1/1991 | Cadwell | 29/423 |
| 5,139,887 | 8/1992 | Sutton | 428/586 |

*Primary Examiner*—Lowell A. Larson
*Assistant Examiner*—Rodney Butler
*Attorney, Agent, or Firm*—George A. Grove

[57] ABSTRACT

Magnesium hydroxide or mixtures of magnesium hydroxide and boron nitride applied, e.g., by spraying in a liquid vehicle onto surfaces of a sheet of a superplastic formable metal alloy facilitate the forming of such sheet material and the removal of the formed sheet material from the forming tool or die.

7 Claims, 2 Drawing Sheets

LUBRICATION SYSTEM FOR HOT FORMING

TECHNICAL FIELD

This invention pertains to forming processes for certain metal alloys that are capable of being deformed to elongations typically in excess of two hundred percent or more. More specifically, this invention relates to a lubricant composition for use in the elevated temperature, controlled strain rate forming of such superplastic alloys.

BACKGROUND OF THE INVENTION

It is known that certain metal alloys, such as some aluminum alloys and titanium alloys, when processed to a very fine grain size (e.g., $<10\,\mu$) can be heated to a relatively high processing temperature and subjected at a controlled strain rate to achieve total elongations before failure that are quite high for metals. For example, Aluminum Alloys 5083 and 7475 and titanium—6% aluminum—4% vanadium alloys can be processed in the form of cold rolled, fine grain sheets by various forming operations into quite complicated shapes in a single forming operation. A good discussion of such alloys and the practices by which sheets can be formed is found in the *Metals Handbook,* 9th Edition, volume 14 entitled "Forming and Forging," at pages 852–868 in the section entitled "Superplastic Sheet Forming."

In the above Metals Handbook section, some eight aluminum alloy compositions and 12 titanium alloy compositions are described for which superplastic formability has been obtained. When the aluminum alloys are heated, for example, to a temperature in the range of 400° C. to 550° C. and subjected to strain at a rate of $10^{-4}$ to $5\times10^{-3}$ $s^{-1}$, elongations of 400% to 1200% are obtained. Similarly, when the fine grain titanium alloys are deformed at temperatures in the range of 815° C. to 1000° C. at strain rates of $2\times10^{-4}$ to $10^{-3}$ $s^{-1}$, elongations in the range of 100% to 1100% are achieved. A common characteristic of these alloys is that they have a very fine metallurgical grain size of the order of about 10 micrometers, and they are processed at a high temperature usually greater than one-half of the absolute melting point temperature and at a controlled strain rate usually in the range of $10^{-4}$ to $10^{-2}$ $s^{-1}$.

Such alloys are usually processed in sheet form with a thickness of about one to three millimeters by a number of forming methods. The following forming methods have been used with such superplastic alloys: blow forming, vacuum forming, thermal forming, stretch forming and superplastic forming/diffusion bonding, and the like. Basically, such processes involve gripping a sheet of a superplastic formable alloy at its edges, heating the sheet to a suitable superplastic forming temperature, and subjecting one face of the sheet to the net pressure of a working fluid. The heated sheet is thus stretched at a suitable strain rate to expand the sheet against a mold cavity surface or a tool surface. Such practices are described in detail in the "Superplastic Sheet Forming" section of the above-identified volume of the *Metals Handbook.*

In such superplastic sheet forming operations, a lubricant/release agent is often used to (a) provide lubrication as the sheet slides against a forming surface, or (b) provide a stop-off layer between portions of two or more overlying sheets where it is wished to promote only localized diffusion bonding between the sheets as they undergo deformation, or (c) to release a formed sheet(s) from the die or tool member at the completion of the forming operation. Boron nitride or graphite has been employed for such purposes.

There is always, of course, value in finding new and improved lubricant/release agents for sheet metal forming processes. While graphite and boron nitride have proved to be generally suitable, graphite is messy to work with and presents a cleaning problem at the completion of the forming operation. Boron nitride, while it presents less of a cleaning problem, is relatively expensive. Furthermore, graphite and boron nitride are actually too slippery for some sheet forming situations.

SUMMARY OF THE INVENTION

This invention provides a lubricant and lubricant combination for use in superplastic sheet forming operations. The lubricant/release agent is either magnesium hydroxide [$Mg(OH)_2$], used alone or a suitable mixture of magnesium hydroxide and boron nitride (BN). The mixtures suitably contain at least 10% by weight of magnesium hydroxide.

In accordance with the invention, magnesium hydroxide is preferably applied as a sprayable aqueous suspension (commonly, milk of magnesia). Similarly, suitable liquid suspensions of mixtures of magnesium hydroxide and boron nitride are sprayed on the surface of the metal to be formed or of the forming tool or die. A liquid vehicle such as water or alcohol is selected so that it will evaporate either at ambient temperature or upon heating of the sheet and tool to a suitable superplastic forming temperature. For example, in the forming of Aluminum Alloy 5083, the forming operation is carried out at about 500° C. During heating of the lubricant slurry coated workpiece and tool to such high forming temperature, the water or alcohol vehicle is evaporated and a filmy dry residue of $Mg(OH)_2$ (or MgO) and BN remains. Both the MgO and BN retain their desired lubricant properties at the forming temperatures for superplastic aluminum and titanium alloys.

As is known, boron nitride is a slippery, relatively low friction lubricant. However, magnesium hydroxide or magnesium oxide, depending upon the forming temperature, provides a higher coefficient of friction which is very useful in many superplastic sheet forming operations. When a superplastic sheet is deformed into a pan shape or other complex shape, different regions of the sheet experience different elongation and may require different lubricant properties.

Some high elongation regions of a sheet require relatively low coefficient of friction properties. For this situation, mixtures of magnesium hydroxide and boron nitride that contain only about 20% to 50% by weight magnesium hydroxide are particularly suitable. For example, those regions of a sheet that are expected to slide against a surface of a die wall or other forming tool are suitably provided with such a mixture. In contrast, those portions of a sheet that fold and are deformed about a sharp radius, such as the edge of the cavity where the sheet is initially secured, benefit from a very high proportion of magnesium hydroxide. Magnesium hydroxide is found to provide suitable barrier and lubricant properties to facilitate fairly rapid forming of an aluminum sheet about a sharp radius without tearing or puncturing.

While it is preferred to use magnesium hydroxide in an aqueous slurry, it would also be appropriate to use a precursor of magnesium hydroxide such as magnesium oxide. Magnesium hydroxide and mixtures of magnesium hydroxide and boron nitride provide excellent lubricating/releasing properties at sheet forming temperatures, particularly for superplastic aluminum alloys and superplastic titanium alloys. Moreover, the residue is readily removed from the surface of the formed sheet with soap and water. The milk of magnesia, obviously, is relatively inexpensive compared to boron nitride and provides a cost reduction benefit.

Other objects and advantages of the invention will become apparent from a detailed description thereof which follow. Reference will be had to the drawings.

DESCRIPTION OF A PREFERRED EMBODIMENT

Figure 1A:
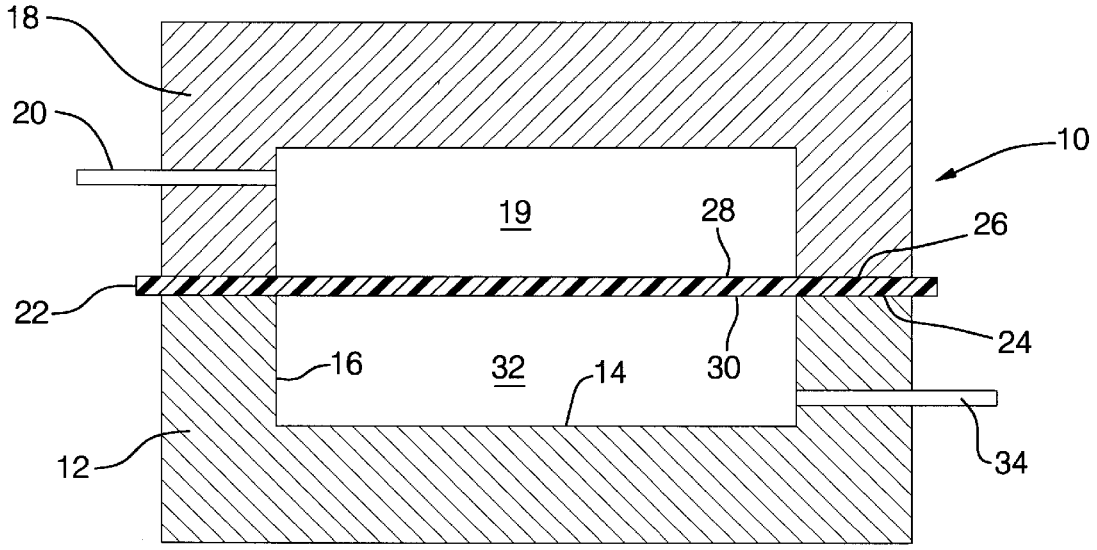
FIGS. 1A through 1D show four steps in the superplastic forming of a representative aluminum alloy sheet.

A practice of the subject invention will be illustrated in the deformation of Aluminum Alloy 5083, which is commercially available in sheet form and in a suitable metallurgical condition for superplastic deformation. While the practice of the invention will be described in connection with the forming of Aluminum Alloy 5083, it is to be appreciated that the subject lubricant is suitable for use in superplastic forming of other aluminum and titanium alloy sheet compositions at temperatures up to 1000° C. or so.

Aluminum Alloy 5083 has a nominal chemical composition, by weight, of 4 to 4.9 percent magnesium, 0.4 to 1 percent manganese, 0.05 to 0.25 percent chromium, about 0.1 percent copper, and the balance substantially aluminum except for impurities. A cast slab of this composition is typically subjected to homogenizing heat treatment, hot rolled to form a long plate and then cold rolled to form a long sheet of final thickness in the range of about 1 to 3 millimeters. A final heat treatment may be provided such that the sheet has a very fine grain structure. Suitably shaped blanks of the superplastic sheet material may then be heated to a temperature in the range of about 500° C. to 540° C. and subjected to forming operations at a strain rate in the range of about $10^{-4}$ to $10^{-3}$ seconds$^{-1}$.

FIGS. 1A through 1D illustrate schematically a practice for blow or stretch forming of a sheet of superplastic Aluminum Alloy 5083. A suitable blow forming tool is indicated at 10 in cross section. Forming tool 10 includes a female die member 12. The female die member 12 has part shaping surfaces including bottom surface 14 and wall 16. Die 12 defines a shallow pan which may be, for example, circular (as shown) or other cross section. A complementary working gas chamber member 18 provides a pressure chamber 19 for confining a working gas or other suitable fluid under pressure. Inlet means 20 is provided in chamber member 18 for introducing a suitable working gas such as air or argon.

A superplastic formable Aluminum Alloy 5083 sheet 22 is interposed between tool member 12 and chamber member 18. Tool 12 and chamber 18 members have complementary sealing surfaces 24 and 26, respectively, adapted to sealingly engage against the upper 28 and lower 30 surfaces of sheet 22. One or both of surfaces 24 and 26 may have sealing lips or the like (not shown) to sealingly engage the edges (or flange portions) of sheet 22 so as to maintain a working pressure in chamber 19 at a suitable time in the process. Sheet 22 is thereby prevented from being drawn past surfaces 24 and 26. In order to be formed against tool surfaces 14 and 16, all deformation of sheet 22 is by stretching of the portions made of surfaces 24 and 26.

As seen in FIG. 1A, an unformed but superplastically formable 5083 sheet 22 is in position between die member 12 and chamber member 18. Means (not shown) are provided to heat both the tool 10 and sheet 22 to a suitable superplastic-forming temperature. During the heating, ambient pressure argon gas is maintained both in chamber 19 and in the cavity 32 of tool 12 to suitably protect the sheet from atmospheric corrosion. An inlet/vent 34 is provided in the die 12 to suitable provide argon for this purpose and to permit venting of the argon from the cavity when sheet 22 is stretched. When the tool and the sheet have reached a superplastic working temperature, for example, 500° C. for Aluminum Alloy 5083, the vent is opened in cavity 32 and argon under pressure is introduced into chamber 19. Argon pressure is applied against the upper surface 28 of sheet 22 so as to stretch it at a controlled strain rate in the range of about $10^{-4}$ inches/inch second to $10^{-3}$ inches/inch second. Since parts of the sheet may undergo elongation of the order of 300%, it is seen that the forming process is relatively slow. It is for this reason that any lubricant or other means that can be employed to increase the rate of the forming process will provide efficiencies.

Figure 1B:
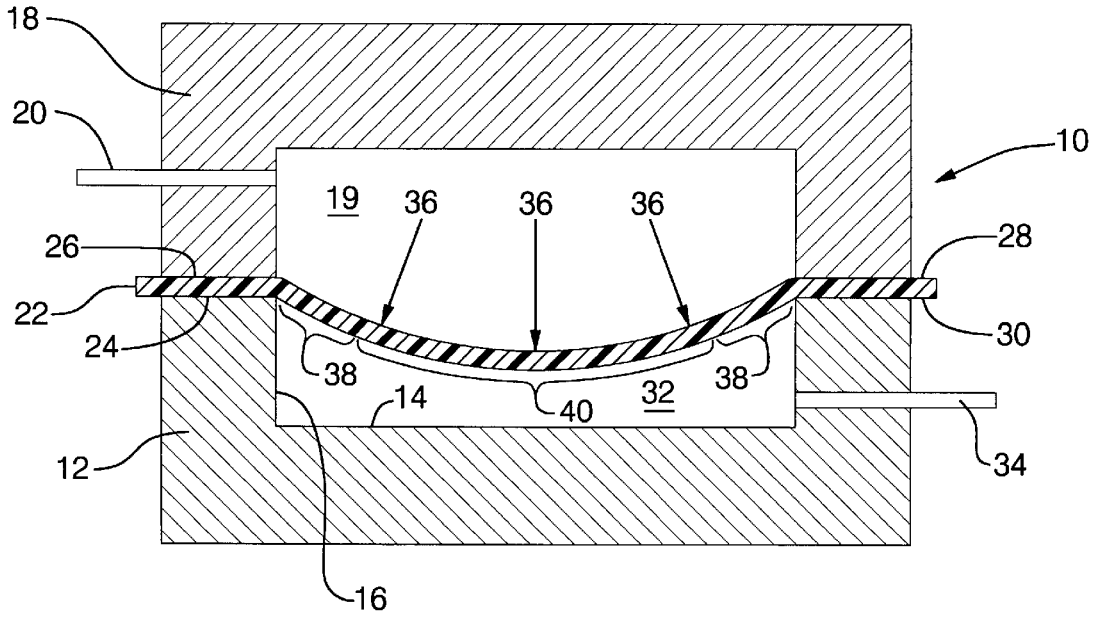
Figure 1C:
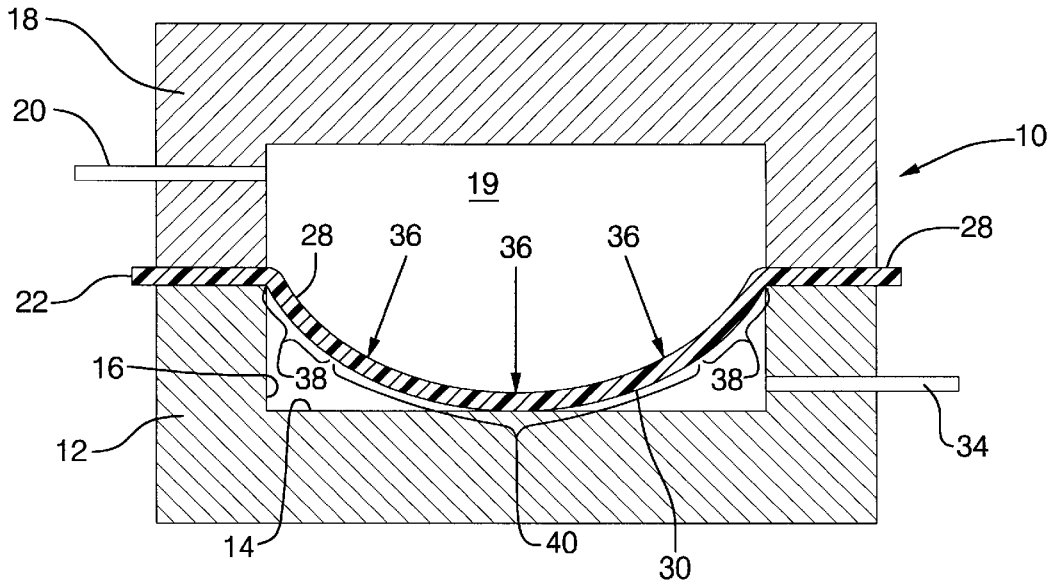

As depicted in FIG. 1B, the pressure (arrows 36) of the argon acting upper surface 28 of sheet 22 has commenced to deform the sheet downwardly toward the wall 16 and bottom 14 of tool 12. In FIG. 1C, the center portion of the bottom 30 of sheet 22 has just engaged the bottom surface 14 of female die 12. Further deformation as seen in FIG. 1D forces the superplastic formable sheet against the walls 14, 16 of the forming tool 12.

Typically, two different types of lubrication are useful in the forming of a sheet in this kind of configuration. In the region best illustrated at brackets 38 in FIG. 1B, the lower surface 30 of sheet 22 is being caused to bend and form around the lip of tool surface 24. In region 38, a lubricant/parting agent with a relatively high coefficient of friction is preferred. For this purpose, the use of magnesium hydroxide alone as lubricant is preferred. In the region indicated at 40 in FIG. 1B, surface 30 will engage and slide against the forming surfaces of tool 12. In region 40 of the forming sheet, it is desirable to have higher lubricity. For this reason, sprayable slurry mixtures of boron nitride and magnesium hydroxide containing 20% to 60% boron nitride are preferred.

Figure 1D:
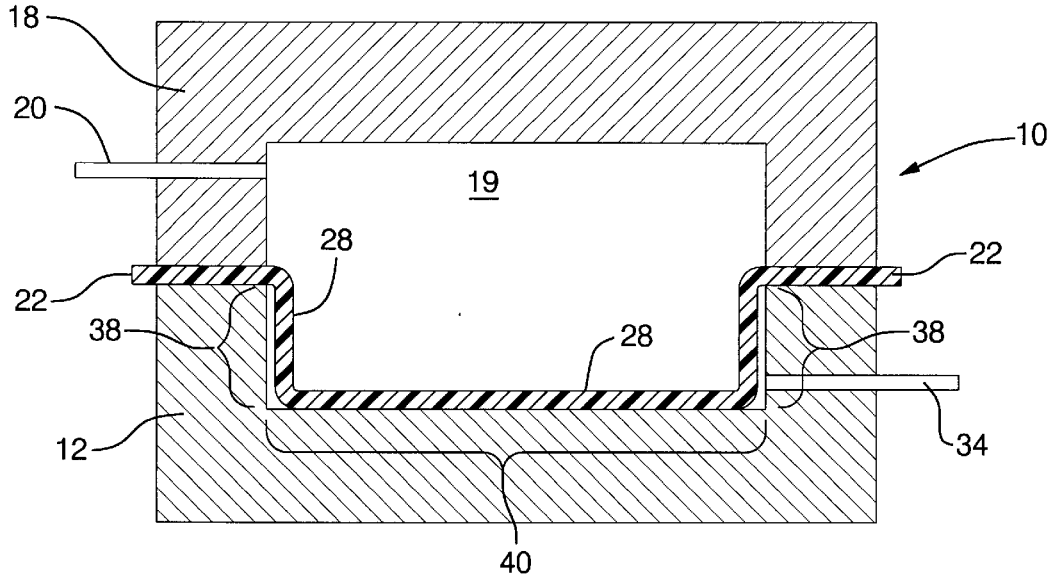

FIG. 1D illustrates the completion of the forming sequence carried out on sheet 22 in tool 10. A straight wall round pan structure has been formed. It is a severe deformation of the sheet 22. The sheet has been deformed around the inside edges of die surface 24 and into conformity with bottom surface 14 and vertical wall 16. A further discussion of the lubrication aspect of the forming process follows below.

At the completion of the forming operation, the upper chamber tool member 18 is lifted from engagement with the upper surface 28 of sheet 22 and the formed panel is removed from the lower tool member 12. The lubricant also serves to assist in the release of the formed part from the tool surfaces. Since the forming processing is time consuming, it is desired to remove the part while it is still at a fairly high temperature so as to save tool reheating time and processing time in preparation for the next part to be formed.

This invention provides the use of magnesium hydroxide and mixtures of magnesium hydroxide with boron nitride in proportions of up to 90 percent by weight boron nitride in connection with the forming of superplastic formable aluminum or titanium alloy sheets. The proportion of boron nitride, if any, included in the lubricant depends as suggested above on the requirements of the forming operation itself. In many applications, magnesium hydroxide is suitable for bending and low elongation operations. In other cases where the strain on the part is severe and greater lubricating properties are required, it may be desirable to use a preponderance of the boron nitride. Appreciable amounts of magnesium hydroxide can be used with boron nitride to provide substantially the same lubricity as boron nitride but at lower cost. The materials are readily mixed, particularly in a water or alcohol vehicle. They are substantially insoluble in these liquids. There is no problem with mixing them in any desired proportion and sufficient suspending liquid as to be sprayable. After they are dried on the surface and the forming operation has been completed, the lubricants are readily removed from the formed part using water. The lubricants are clean and easy to use throughout the processing.

In tests carried out in the practice of the invention, commercial milk of magnesia, $Mg(OH)_2$, was used alone or mixed with a grade of boron nitride obtained as a bulk mold release agent. The aqueous milk of magnesia/boron nitride mixtures were diluted with alcohol and applied to sheet surface with a hand-operated high volume, low pressure feed sprayer. The solution was sprayed onto the superplastic formable blank and allowed to dry. It is usually important that the lubricant film be applied uniformly so as to avoid buildup on the tools, which could affect the surface quality of the part. The magnesium hydroxide or magnesium hydroxide/boron nitride lubricant mixtures were removed from formed panels using soap and water. No flaking of the lubricant or transfer to the operator occurred.

Friction tests were devised to simulate forming operations.

Friction data has been obtained on magnesium hydroxide and mixtures of magnesium hydroxide with boron nitride under conditions designed to simulate superplastic sheet forming conditions. The testing involved applying the lubricant as described above to a sheet of aluminum alloy 5083. The lubricant-coated sheet was placed in contact with a rotating steel plate to simulate a forming operation. The tests were performed at 500° C. with a 200 Newton load on the lubricant-coated sheet and simulating a strain rate of $5\times10^{-4}$/second. The testing determined a friction coefficient as a function of elapsed time up to about six minutes for the various lubricants to simulate a forming operation of that duration.

Friction tests were performed on mixtures of magnesium hydroxide and boron nitride in the following ratios: 0:1, 1:4, 1:1, 4:1 and 1:0, which gave samples having 0, 20, 50, 80 and 100 percent magnesium hydroxide. Pure magnesium hydroxide and an 80/20 mix of magnesium hydroxide with boron nitride exhibited a higher coefficient of friction than undiluted boron nitride over the period of the testing. However, very little difference in friction coefficient was observed between pure boron nitride and boron nitride with 20% and 50% magnesium hydroxide. This indicates that a $Mg(OH)_2$ diluted boron nitride would provide about the same lubricity in the superplastic forming operation as pure boron nitride. However, the magnesium hydroxide-diluted boron nitride would provide a cost savings.

Superplastic forming experiments utilizing magnesium hydroxide as a lubricant/parting agent were conducted on two dies that simulated forming conditions encountered in commercial superplastic forming operations.

The first die (pan 1) was a shallow pan, about 50 millimeters deep, shaped like the female die 12 of FIG. 1A–1D with a very sharp (2.0 mm) die entry radius. The overall strain in a part of this configuration is relatively low (0.7 max. true thickness strain). However, the sharp entry radii created a unique forming condition. Part failure generally occurs in this part by necking or splitting below the entry radius.

Superplastic forming trials were performed on a pan 1 configuration to determine a lubricant that could best produce an acceptable part with the fastest cycle time. Lubricants tested include graphite, boron nitride, magnesium hydroxide and talc [$Mg_3Si_4O_{10}(OH)_2$]. The 100% magnesium hydroxide gave a significant improvement in formability and reduced cycle time compared to the high lubricity materials—graphite and boron nitride. With graphite or boron nitride as the lubricant, the fastest cycle time which could be used without any necking was eight times longer than the time required to form the pan 1 configuration with magnesium hydroxide. Talc also produced a good part in about the same cycle as the magnesium hydroxide. However, talc was messy to work with, gave off air-borne particles and built up on the die. Thus, the high coefficient of friction magnesium hydroxide lubricant has particular utility in the forming of parts with sharp die entry radii to achieve fast forming times.

A second part configuration was tested (pan 2). Pan 2 is a tool that has a deep (125 mm) straight wall pan but with a generous entrance radii (25.4 mm). This pan required high strains (1.3–1.5 true thickness strain) to form the part. Pan 2 parts fail by excessive cavitation or splitting in the bottom corners of the pan.

Superplastic forming trials were formed on the pan 2 configuration to determine whether magnesium hydroxide enabled suitable forming of the bottom corners with no splitting or significant cavitation. Using magnesium hydroxide as the forming lubricant led to some cavitation in the bottom corner. However, the use of a 70 boron nitride/30 magnesium hydroxide (parts by weight) mixture resulted in successful part formation with no visible cavitation. While pure boron nitride could also successfully form the part, the diluted boron nitride lubricant with magnesium hydroxide provides a lower cost alternative.

In addition to improved formability, magnesium hydroxide and magnesium hydroxide/boron nitride mixtures are cleaner to use than graphite. Graphite lubricant-coated parts produce many air-borne particles during part removal. No flaking of magnesium hydroxide or magnesium hydroxide/boron nitride mixtures is observed. Any overspray of the mixture during application is easily cleaned with soap and water. After forming with magnesium hydroxide/boron nitride mixtures, the residue material is readily removed from the part by scrubbing with soap and water. Removal of graphite requires an acid wash or vapor blasting.

The use of magnesium hydroxide and magnesium hydroxide/boron nitride mixtures are useful in the superplastic forming of aluminum and titanium alloy sheet materials. It is likely that some parts will have regions where different lubricant properties are needed requiring different combinations of $Mg(OH)_2$ and BN. Magnesium hydroxide and boron nitride can be applied using a dual feed system and where the magnesium hydroxide and boron nitride are mixed in a desired ratio prior to spraying. The ratio can be varied during application to produce a sheet blank with selected areas of relatively high and relatively low friction.

Thus, this invention provides a lubricant combination that can be used at the high temperatures of superplastic forming of aluminum alloy and titanium alloy sheets. It can be used in virtually any variation of the processes that are employed in the superplastic forming of sheet materials. While the invention has been described in terms of a specific embodiment thereof, it will be appreciated that other forms could readily be adapted by one skilled in the art. Accordingly, the scope of the invention is to be considered limited only by the following claims.

I claim:

1. In the method of forming a sheet of a superplastic aluminum or titanium alloy by forcing a side of the sheet into conformance with the surface of a shaping tool or die, said method comprising heating said sheet to a superplastic forming temperature, applying a lubricant to at least one of (a) the surface of the shaping tool or die and (b) said side of said sheet, applying fluid pressure to the other side of said sheet so as to deform said sheet at a superplastic strain rate into conformance with said tool or die surface, and thereafter removing the deformed sheet from said tool or die surface; the improvement wherein said lubricant as applied comprises magnesium hydroxide or mixtures of magnesium hydroxide and boron nitride containing at least ten percent by weight magnesium hydroxide.

2. A method as recited in claim 1 in which said superplastic metal alloy is an aluminum alloy.

3. A method as recited in claim 1 in which said superplastic metal alloy is aluminum alloy 5083.

4. A method as recited in claim 1 where said lubricant release agent is a slurry of magnesium hydroxide in a non-solvent, liquid vehicle.

5. A method as recited in claim 1 where said lubricant/release agent is a slurry of magnesium hydroxide and boron nitride in a non-solvent, liquid vehicle.

6. A method as recited in claim 1 in which said sheet includes a region that undergoes relatively little elongation and magnesium hydroxide is applied to said region.

7. A method as recited in claim 1 in which said sheet includes a region that undergoes substantial elongation and a mixture of magnesium hydroxide and boron nitride comprising 50 percent by weight or more boron nitride is applied to said region.

* * * * *